United States Patent [19]

Harrington

[11] Patent Number: 4,642,856

[45] Date of Patent: Feb. 17, 1987

[54] CLAMP ASSEMBLY FOR INFLATABLE MEMBRANE CONCRETE FORM

[76] Inventor: Horrall Harrington, 613 Berlin Rd., Pittsburgh, Pa. 15221

[21] Appl. No.: 361,521

[22] Filed: Mar. 24, 1982

[51] Int. Cl.[4] ..... E04G 11/04

[52] U.S. Cl. ..... 24/531; 52/2; 160/395; 160/392

[58] Field of Search ..... 24/243 K, 30.5, 30.5 L, 24/72.5; 160/392, 395, 327, 328, 329, 402, 403; 52/2

[56] References Cited

U.S. PATENT DOCUMENTS

| | | | |
|---|---|---|---|
| 662,647 | 11/1900 | Howe | 160/395 |
| 2,914,776 | 12/1959 | Hotz | 160/392 |
| 3,719,341 | 3/1973 | Harrington | 52/2 |
| 3,851,848 | 12/1974 | Wiele | 24/243 K |
| 3,975,915 | 7/1976 | Haw | 52/2 |
| 4,158,244 | 6/1979 | Stefan | 24/243 K |
| 4,337,815 | 7/1982 | Lindström | 160/327 |

*Primary Examiner*—Gene Mancene
*Assistant Examiner*—John G. Weiss
*Attorney, Agent, or Firm*—Kinzer, Plyer, Dorn & McEachran

[57] ABSTRACT

An edge clamp assembly for an inflatable form membrane used in erection of a concrete shell comprises a steel channel having an internal width W mounted at the base of the shell with the longitudinal opening of the channel facing upwardly; a guide lip on one channel leg projects a short distance over the channel opening. A first rectangular wood rail is wrapped in an edge portion of the membrane and inserted into the channel, fitting loosely into the bottom of the channel; a second rectangular wood rail having a width just slightly smaller than W is inserted into the top of the channel, tightly filling the channel opening immediately below the guide lip and releasably clamping both rails and the edge portion of the membrane into the channel.

9 Claims, 4 Drawing Figures

Fig. 1.
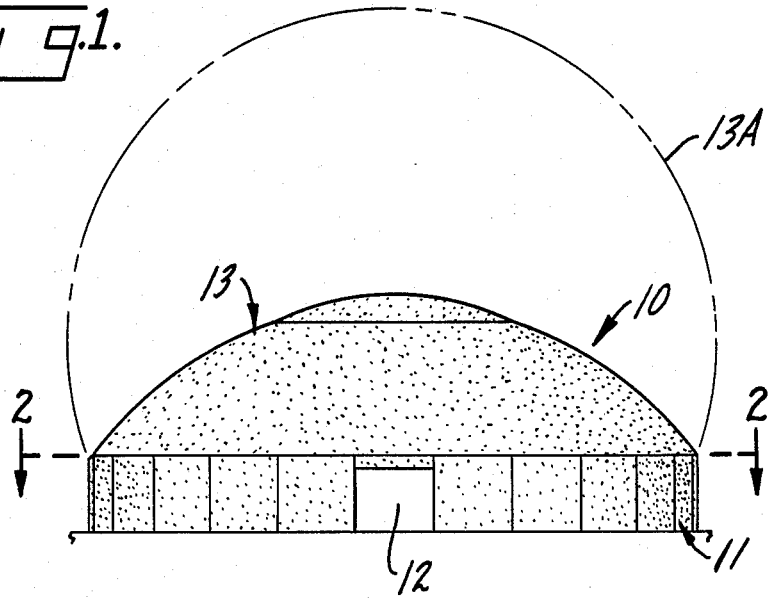
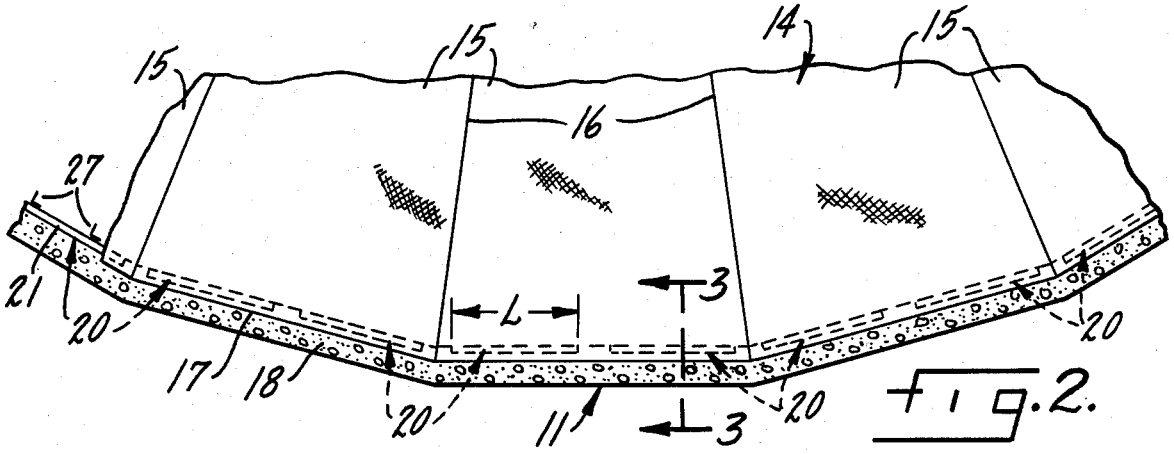
Fig. 2.
Fig. 3.
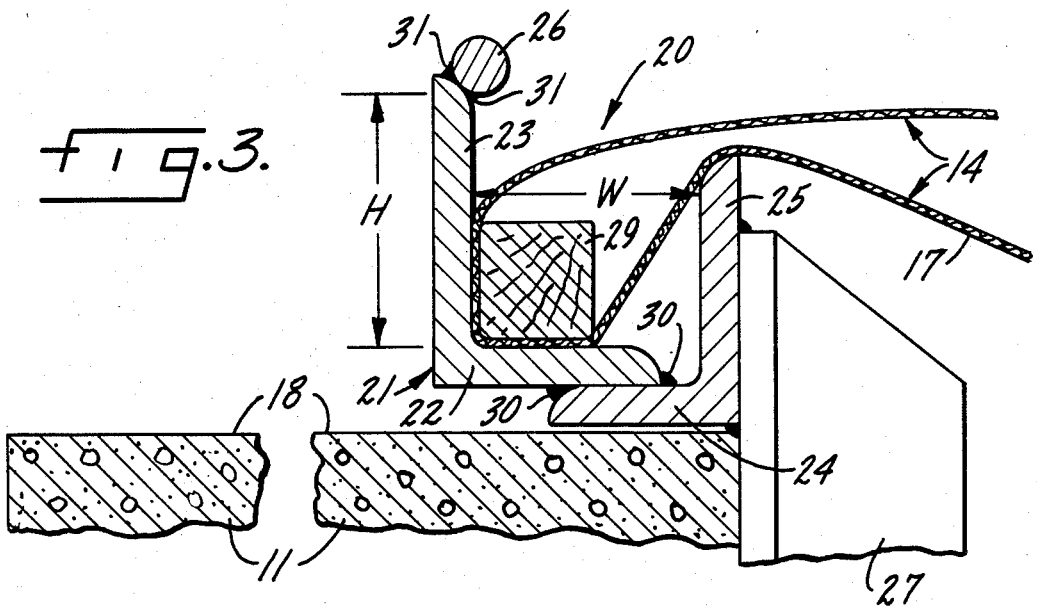

CLAMP ASSEMBLY FOR INFLATABLE MEMBRANE CONCRETE FORM

BACKGROUND OF THE INVENTION

Large concrete shells are being utilized increasingly in the various types of buildings. Most frequently, these are storage buildings with the concrete shell forming a roof of dome-like configuration.

One successful technique for erection of a concrete shell structure utilizes a membrane form, much like an enormous tent, for the complete shell. The form membrane is positioned over the base of a building and is inflated to afford a continuous cover of dome-like configuration. Concrete is then applied to the surface of the inflated membrane. The concrete is usually applied to the exterior of the membrane, although internal application can be utilized as disclosed in U.S. Pat. No. 3,118,010, Herrall Harrington, issued Jan. 14, 1964. Another technique for erecting concrete shells employs a multi-use form assembly comprising a structural frame with a two-layer inflatable membrane form mounted on the frame. The form assembly is aligned with a part of the building foundation, the form is inflated, reinforcing members are positioned on the external surface of the membrane form, and concrete is then deposited on the surface of the inflated form. After the concrete sets, the form is deflated and the form assembly is moved to a new position to form a further segment of the total shell. This segmental construction technique is described in Harrington U.S. Pat. No. 3,619,432, issued Nov. 9, 1971.

In the use of inflatable membrane forms for the erection of concrete shells, one of the more difficult continuing problems lies in the necessity for securing and sealing the edges of the form membrane to a building base or to a form support structure positioned immediately adjacent the foundation or other base for the building. If the edges of the form membrane are fastened down by retaining strips that use nails, bolts, or other like fasteners, tearing of the membrane is a frequent problem, particularly if the membrane is used repeatedly in constructing a multi-segment shell or in the erection of a plurality of individual shells. Moreover, such conventional fastening means make it difficult to remove the form membrane for subsequent reuse, and damage to the edge portions of the membrane almost inevitably occurs.

A releasable clamp assembly that has been used successfully for a number of years in securing the edge portions of an inflatable membrane form for use in erection of a concrete shell is described in Harrington U.S. Pat. No. 3,719,341, issued Mar. 6, 1973. That clamp assembly comprises a metal channel that is mounted on a support at the base of the shell, facing outwardly. The support is usually a part of the building. A wood rail is wrapped in the edge portion of the form membrane and is then inserted into the longitudinal opening of the channel. In the embodiment most used commercially, an auxiliary rail is positioned within the channel, below, the main rail on the outside of the fabric. That clamp assembly is quite useful and effective because it requires no nails, screws, or like fasteners. The tension on the membrane produced when the form is inflated helps to hold the rails and the membrane edge in the clamp channel. When the form is deflated, on the other hand, the form membrane can be released from the clamp channel for reuse.

The clamp assembly of Harrington U.S. Pat. No. 3,719,341, however, has some remaining disadvantages. Thus, when the form membrane is being secured to the clamp assemblies, close cooperative effort is required between two workmen, one working on the inside of the inflatable form and the other positioned outside of the form. If these two workmen are not effective in coordinating their efforts, substantial time can be lost and, on occasion, the edge portion of the form membrane may be damaged. Furthermore, that clamp assembly is limited to use with a form membrane which, when inflated, extends back over the top of the clamp channel at an acute angle. If inflation of the form produces tension in a direction outwardly of the longitudinal opening of the channel, the edge portion of the form is pulled out of the channel. Finally, the clamp assembly presents some difficulty when the concrete shell has set and removal of the form membrane is desired because the concrete at the rim of the shell usually covers the longitudinal opening of the clamp assembly channel, making it necessary to remove the entire clamp assembly before the edge of the membrane can be disengaged from the clamp.

SUMMARY OF THE INVENTION

The object of the present invention, therefore, is to provide a new and improved clamp assembly for mounting an edge portion of the membrane of an inflatable form for a concrete shell on a support at the base of the shell.

A further object of the invention is to provide a new and improved edge clamp assembly for an inflatable form membrane, used in the erection of a concrete shell, that is easy to install and use, requiring only a single workman positioned within the interior of the membrane form.

Another object of the invention is to provide a new and improved edge clamp assembly for an inflatable form membrane, used in the erection of a concrete shell, that is effective for a variety of different shell configurations in which the membrane extends above the clamp assembly over a wide angular range.

A particular object of the invention is to provide a new and improved edge clamp assembly for an inflatable membrane form, used in the erection of a concrete shell, that is simple and economical in construction, that can be reused many times, and that allows for rapid removal of the membrane from the clamp assembly immediately upon deflation of the form.

Accordingly, the invention relates to a clamp assembly for mounting an edge portion of the membrane of an inflatable form for a concrete shell on a support at the base of the shell. The clamp assembly comprises a channel of substantially U-shaped cross-sectional configuration, including first and second legs joined by a base of internal width W, the first leg having a height H and including a guide lip projecting a short distance into the longitudinal opening of the channel, and the second leg having a height not substantially less than H. The assembly further comprises mounting means for mounting the channel on a support at the base of the shell with the channel legs projecting upwardly from the base so that the longitudinal opening of the channel faces upwardly. A first rail is wrapped in an edge portion of the form membrane, the first rail having a cross-sectional configuration affording a plurality of relatively sharp corners and having maximum dimensions substantially smaller than H and W to allow the first rail to fit easily into the bottom of the channel. A second rail is fitted tightly into the channel above the first rail, filling the longitudinal opening of the channel immediately below the guide lip and releasably clamping both rails and the edge portion of the membrane into the channel.

BRIEF DESCRIPTION OF THE DRAWINGS

FIG. 1 is an elevation view of a simple concrete shell structure of a kind in which the clamp assembly of the present invention may be employed during construction;

FIG. 2 is a detail view, taken approximately as indicated by line 2—2 in FIG. 1, illustrating the manner in which an inflatable membrane form is mounted upon the base of the building of FIG. 1 during construction of the building;

FIG. 3 is a detail sectional view, drawn to a greatly enlarged scale, taken approximately as indicated by line 3—3 in FIG. 2, at a preliminary stage in the mounting of the inflatable membrane form on the base for the concrete shell.

DESCRIPTION OF THE PREFERRED EMBODIMENTS

Figure 4:
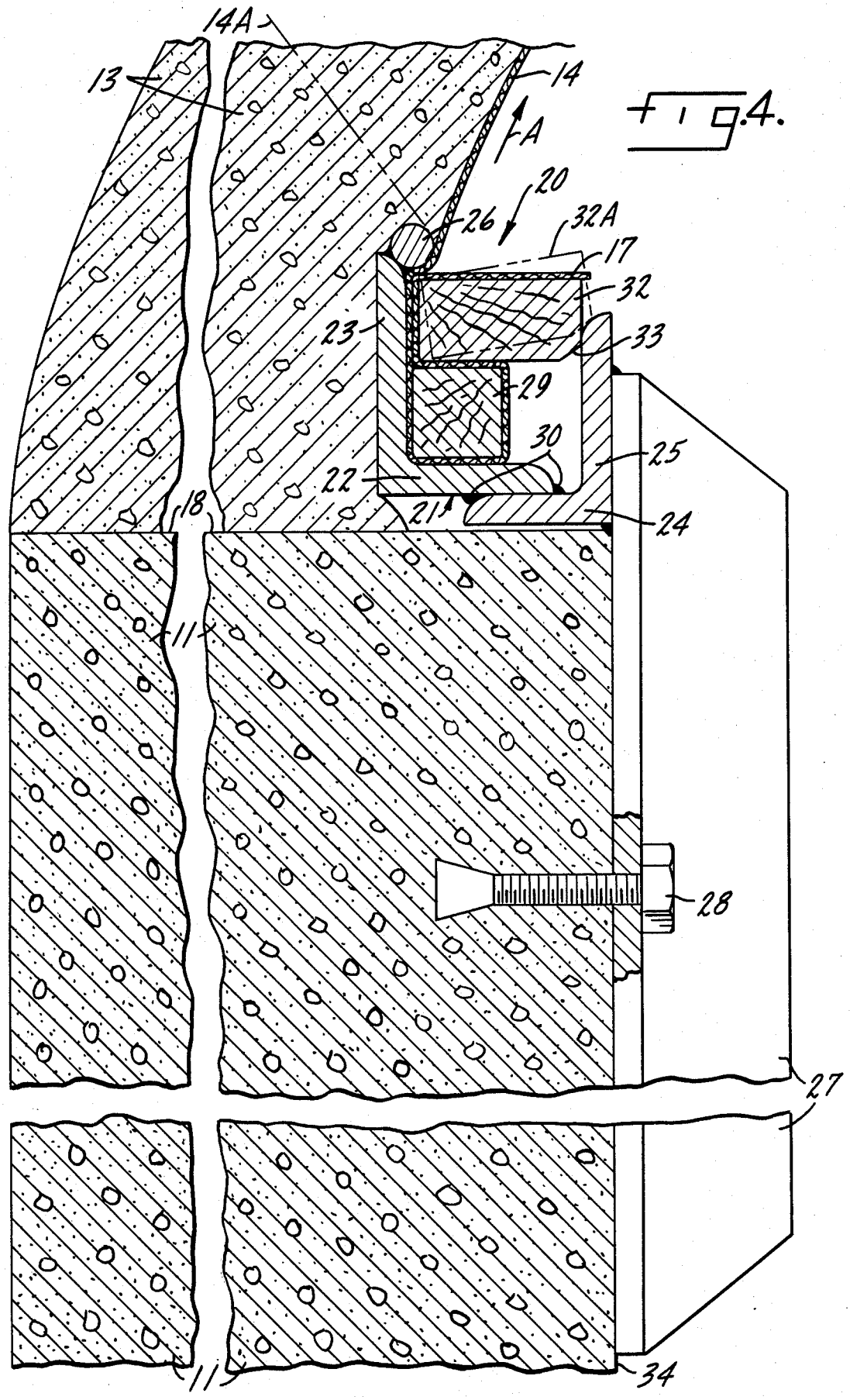
FIG. 4 is a detail view like FIG. 3 but showing the final mounting of the membrane form and the manner in which the concrete is applied to the form in erection of the shell.

FIG. 1 illustrates a concrete storage building 10 that is typical of a simple type of concrete shell building in which the clamp assembly of the present invention may be utilized. Building 10 includes a cylindrical base 11 that is of generally circular configuration but is actually formed as a polyhedron of multiple sides. Usually, base 11 is erected with conventional fixed forms and may include one or more access doorways 12. Building 10 is covered by a concrete shell roof 13 of shallow dome-like configuration. Building 10 is typical of bulk storage structures employed for storage of granular material such as coal, fertilizer, grain, sand, or the like. The diameter of building 10 is likely to range from fifty feet or less up two hundred fifty feet or more.

To erect the concrete shell dome roof 13, it is customary to spread a form membrane of appropriate size and configuration over the top of base 11, following which the edge of the form membrane is clamped to the inside top surface of the building base. Air is then forced, under pressure, into the interior of the base beneath the form membrane, inflating the membrane to a configuration approximating that of shell 13. Reinforcing steel, usually constituting steel cables, welded wire mesh, and rebars, is then mounted on top of the form membrane, being spaced outwardly of the form by suitable chairs. With the reinforcement in place, concrete is then applied to the outer surface of the inflated membrane form, usually in successive layers, until the desired thickness is achieved for shell 13. When shell 13 is complete and the concrete has set, the air pressure within the form is reduced to atmospheric pressure and the form is removed so that it will be available for subsequent reuse.

FIG. 2 provides a general illustration of the manner in which a form membrane 14 is mounted upon base 11. The form membrane 14 is usually constructed as a series of segments 15 joined by seams 16. Only a small part of membrane 14 adjacent a segment of base 11 is shown in FIG. 2. The edge 17 of membrane 14 is securely mounted on and effectively sealed to the inner edge of the top surface 18 of concrete base 11.

This is accomplished by means of a plurality of clamp assemblies 20, the locations of the individual clamp assemblies being generally indicated in dash lines in FIG. 2. Each clamp assembly 20 has a length L preferably in a range of about two feet to about four feet. Each clamp assembly 20 has a construction such that a single workman, positioned inside base 11, can use the clamp assemblies to mount successive edge portions of membrane 14 to the top of base 11.

As shown in FIGS. 3 and 4, each clamp assembly 20 comprises a structural steel channel 21. In the illustrated construction, channel 21 is formed by welding two L-shaped steel members 22 and 24 together as indicated by the welds 30. It will be understood, however, that channel 21 may be a unitary channel, if desired, instead of the illustrated welded construction.

Channel 21 includes a first leg 23 that is a part of member 22 and a second leg 25 constituting a part of member 24. The first leg 23 of channel 21 has an effective height H. The second channel 25, as illustrated, preferably has a height somewhat smaller than the first leg height H. The first leg 23 of channel 21 includes a guide lip 26 projecting a short distance into the longitudinal opening of the channel, toward the second leg 25. In the construction shown in FIGS. 3 and 4, guide lip 26 is provided by a continuous steel rod welded to the top of leg 23 as indicated by the welds 31.

Clamp assembly 20 further comprises mounting means for mounting channel 21 on the building base 11 or on some other support at the base of the concrete shell to be erected by use of form membrane 14. As shown in FIGS. 3 and 4, this mounting means may comprise one or more steel mounting members 27 welded to the angle member 24 that forms the second leg 25 of channel 21. A series of anchor bolts, such as the expansion type anchor bolt 28 shown in FIG. 4, can be used to secure the mounting members 27 to the interior face 34 of the base wall 11. The mounting means 27,28 is typical but not critical; other appropriate mounting means may be utilized as desired. When mounted on base wall 11, or on a suitable support immediately adjacent to the base wall, the legs 23 and 25 of channel 21 project upwardly from the base so that the longitudinal opening of channel 21 faces upwardly as shown in FIGS. 3 and 4.

Each clamp assembly 20 further comprises a first rail 29 (FIGS. 3 and 4). The first rail 29 is preferably a wood rail; as shown, rail 29 is of rectangular cross-sectional configuration with a height and width of about one-half H. In the illustrated construction, height H is approximately equal to the channel width W, so that the outside dimensions of rail 29 are also approximately equal to one-half W. The first rail 29 need not be of square cross-sectional configuration. However, it should have a cross-sectional configuration affording a plurality of relatively sharp corners, and its maximum dimensions should be substantially smaller than the dimensions H and W to allow the rail to fit easily into the bottom of channel 21.

Clamp assembly 20 further comprises a second rail 32, again preferably formed of wood. The second rail 32, shown in FIG. 4, is preferably rectangular in cross-sectional configuration, having a height that is about equal to one-half H and a width that is only slightly smaller than the channel width W. One corner of the rail 32 is beveled, throughout the length of the rail, as indicated by bevel 33. Rails 29 and 32 may be of any convenient lengths up to the length L of channel 21. In practice, odd lengths can be used so long as their ends are butted and approximately the full length of the steel channel is filled.

In the erection of building 10 (FIG. 1) after the cylindrical polyhedron base 11 is completed, the channel members 21 of clamp assemblies 20 are mounted around the internal periphery of base 11 as generally indicated by the series of dash lines 20 in FIG. 2. The form membrane 14 is then spread across the interior of base 11 and the edge 17 of the membrane form is pulled to the top surface 18 of base 11.

With the form membrane 14 in place, a convenient length L of the membrane edge 17 is wrapped around the first rail 29 for one of the clamp assemblies 20 and that rail and the wrapping portion of the membrane are positioned in channel 21 as shown in FIG. 3. As is readily apparent from FIG. 3, rail 29 and the wrapping portion of membrane edge 17 fit easily into the bottom of the channel. The loose edge 17 of the form membrane is then lifted and the second rail 32 is inserted under it, as generally indicated by the dash outline 32A in FIG. 4. The second rail 32 is then forced downwardly into the longitudinal opening of channel 21 to the position shown in solid lines in FIG. 4. This forces the membrane against the inside surface of the first channel leg 23 and also forces the first rail 29 down into the bottom of the channel. Successive adjoining portions of the edge of the form membrane are secured in the other clamp assemblies 20 around the periphery of base 11 in this manner until the entire perimeter 17 of form member 14 is securely anchored and sealed to the top of base 11.

The interior of base 11 and form 14 is now filled with air under substantial pressure, inflating the membrane form. The resulting upward tension force on form 14, indicated by arrow A in FIG. 4, pulls upwardly on the first rail 29 in each clamp assembly 20, securely clamping the membrane between the guide lip 26 and the second rail 32. Any increase in the tension force, produced by increasing inflation pressure, increases the clamping force.

If any slippage tends to occur in one of the clamp assemblies 20, after assembly and with the form inflated as shown in FIG. 4, the edge portion 17 of the form membrane must move downwardly along channel leg 23 while clamped directly in contact with the adjacent upwardly moving portion of the membrane. This serves only to increase the anchoring action. The sharp bends in the membrane around the corners of the two rails, particularly the first rail 29, provide further frictional restraint which increases with any increase in the tension force A. Further resistance to movement of the membrane is provided by the clamping force applied to the portion of the membrane trapped between rails 29 and 32.

The overall result is a clamp assembly that is easily capable of withstanding high tension forces due to inflation of membrane form 14, without damage to the form.

With the membrane form 14 inflated, as shown in FIG. 4, the concrete for shell 13 is applied to the form as shown in that Figure. The concrete constituting shell 13 is all located exteriorly of channel 21; it does not extend across the longitudinal opening of the channel.

After all of the layers of concrete constituting shell 13 have been applied, and the concrete has set sufficiently, it is a simple matter to remove membrane form 14. First, the air pressure inside of the completed shell is reduced to near atmospheric, so that the tension forces on form 14 (arrow A) are negligible. However, the membrane form tends to adhere to the interior surface of shell 13. With the release of tension on the fabric, the clamping action of clamp assembly 20 is dissipated. The second rail 32 can be easily removed by prying up its inner face with a screwdriver or a chisel. The edge portion 17 of the form membrane and the first rail 29 are then easily removed from within channel 21 in each of the clamp assemblies 20. Backing out bolts 28 permits removal of the steel channels 27; the clamp assemblies 20 and membrane form 14 are both available for reuse.

Clamp assemblies 20 afford substantial advantages in comparison with the best previously known clamps for inflatable membrane forms, the clamps of Harrington U.S. Pat. No. 3,719,341. Thus, the prior art clamp requires close cooperation between two men, one working on the inside and the other on the outside of the form. In contrast, installation and dismantling of the clamp assemblies 20 is easily carried out by workmen functioning individually on the inside of the form. That is, in the entire operation of the clamp assemblies 20, visibility and placement of both of the rails 29 and 32 is effectively accomplished from the same side of the form.

For dome 13 (FIG. 1) the concrete shell wall extends upwardly and inwardly from the base 11, as shown by membrane 14 in FIG. 4. For other shell configurations, however, this relation may not hold true. Thus, for a much larger shell as indicated by the phantom line 13A in FIG. 1, the membrane must project upwardly and outwardly from each clamp assembly as indicated by phantom line 14A in FIG. 4. With the prior art clamp, this arrangement would tend to pull the clamp apart. Clamp assembly 20, however, readily accommodates this change and is adaptable to virtually any configuration for the membrane form so long as there is some component of upward tension on the membrane.

In FIGS. 3 and 4, clamp assembly 20 is positioned in alignment with the inner surface of base 11, shown as a concrete wall. This alignment, of course, is not essential. For a very thick base, the clamp assemblies could be located nearer the outer surface of base wall 11 (the left-hand surface as seen in FIGS. 3 and 4) to reduce the thickness of shell 13 while retaining a smooth, unstepped transition from the base to the shell, assuming such a smooth transition to be desirable. Conversely, for a relatively thin base it may be desirable to relocate the clamp assemblies further inwardly than shown, relative to the inner surface of the base, to uncover more of the top surface of the base. Indeed, the clamp assemblies may be relocated to allow a shell thickness equal to the base thickness. In some instances, it may also be desirable to reverse the clamps so that channel legs 23 are on the inside and legs 25 on the outside, allowing completion of the clamp assemblies from the outside of base 11.

I claim:

1. A clamp assembly for mounting an edge portion of the membrane of an inflatable form for a concrete shell on a support at the base of the shell, the clamp assembly comprising:

a rigid channel of substantially U-shaped cross-sectional configuration, including first and second rigid legs joined by a rigid base of internal width W, the first leg having a height H and including a guide lip projecting a short distance into the longitudinal opening of the channel, the second leg having a height not substantially less than H;

mounting means for mounting the channel on a support at the base of the shell with the channel legs projecting upwardly from the base so that the longitudinal opening of the channel faces upwardly;

a first rail, of substantially incompressible material, wrapped in an edge portion of the form membrane, the first rail having a cross-sectional configuration affording a plurality of relatively sharp corners joined by flat surfaces and having maximum dimensions substantially smaller than H and W to allow the first rail to fit easily into the bottom of the channel;

and a second rail of substantially incompressible material, having a cross-sectional configuration affording a plurality of flat surfaces and fitting tightly into the channel above the first rail, the second rail filling the longitudinal opening of the channel below the guide lip and releasably clamping both rails and the edge portion of the membrane into the channel.

2. A clamp assembly for an inflatable membrane form for a concrete shell, according to claim 1, in which the first rail is of rectangular cross-sectional configuration.

3. A clamp assembly for an inflatable membrane form for a concrete shell, according to claim 2, in which the channel has a length L, and in which the lengths of the first and second rails are both equal to or less than L.

4. A clamp assembly for an inflatable membrane form for a concrete shell, according to claim 3, in which L is in the range of about two feet to about four feet.

5. A clamp assembly for an inflatable membrane form for a concrete shell, according to claim 1, or claim 2, or claim 3, or claim 4, in which $H \approx W$, the first rail is a wood rail approximately square in cross-sectional configuration, with the width of the sides of the first rail being approximately one-half H, and the second rail is a wood rail of rectrangular cross-sectional configuration.

6. A clamp assembly for an inflatable membrane form for a concrete shell, according to claim 1, or claim 2, or claim 3, or claim 4, in which the second rail is of rectangular cross-sectional configuration having a width slightly smaller than W and a height such that the total height of the two rails is just slightly smaller than H.

7. A clamp assembly for an inflatable membrane form for a concrete shell, according to claim 6, in which the second rail is a wood rail and one corner of the rail is beveled, throughout its length, to facilitate insertion into the channel.

8. A clamp assembly for an inflatable membrane form for a concrete shell, according to claim 7, in which the second leg of the channel has a height slightly smaller than H.

9. A clamp assembly for an inflatable membrane form for a concrete shell, according to claim 1, or claim 2, or claim 3, or claim 4, in which the second leg of the channel has a height slightly smaller than H.

* * * * *